US011446683B2

(12) United States Patent
Sanwald et al.

(10) Patent No.: US 11,446,683 B2
(45) Date of Patent: Sep. 20, 2022

(54) POWDER CONVEYING INJECTOR FOR CONVEYING COATING POWDER AND VENTURI NOZZLE ASSEMBLY

(71) Applicant: GEMA SWITZERLAND GMBH, St. Gallen (CH)

(72) Inventors: Marco Sanwald, Abtwil (CH); Roger Tobler, Gossau (CH)

(73) Assignee: GEMA SWITZERLAND GMBH, St. Gallen (CH)

( * ) Notice: Subject to any disclaimer, the term of this patent is extended or adjusted under 35 U.S.C. 154(b) by 428 days.

(21) Appl. No.: 16/486,480

(22) PCT Filed: Nov. 20, 2017

(86) PCT No.: PCT/EP2017/079815
§ 371 (c)(1),
(2) Date: Aug. 15, 2019

(87) PCT Pub. No.: WO2018/149524
PCT Pub. Date: Aug. 23, 2018

(65) Prior Publication Data

US 2020/0047200 A1 Feb. 13, 2020

(30) Foreign Application Priority Data

Feb. 17, 2017 (DE) ..... 102017103316.5

(51) Int. Cl.
*B05B 7/14* (2006.01)
*B05B 7/00* (2006.01)

(52) U.S. Cl.
CPC ..... *B05B 7/1472* (2013.01); *B05B 7/0075* (2013.01)

(58) Field of Classification Search
CPC ..... B05B 7/0075; B05B 7/1472
See application file for complete search history.

(56) References Cited

U.S. PATENT DOCUMENTS 3,795,348 A * 3/1974 Vertue ..... B24C 5/02 406/194
4,941,778 A * 7/1990 Lehmann ..... B05B 12/085 406/28

(Continued)

FOREIGN PATENT DOCUMENTS

DE 444471 C 5/1927
DE 1601959 A1 8/1970

(Continued)

OTHER PUBLICATIONS

International Preliminary Report on Patentability dated May 29, 2019, received for corresponding PCT Application No. PCT/EP2017/079815, 4 pages.

(Continued)

*Primary Examiner* — Dah-Wei D. Yuan
*Assistant Examiner* — Stephen A Kitt
(74) *Attorney, Agent, or Firm* — Kinney & Lange, P.A.

(57) ABSTRACT

Disclosed are a Venturi nozzle arrangement for powder conveying injectors and corresponding powder conveying injectors. The Venturi nozzle arrangement has a first region, which serves as a drive nozzle, and a second region, which serves as a collecting nozzle, wherein the second region has a channel that serves as a stream collecting channel with a longitudinal axis, and wherein the first region has a nozzle opening which lies axially opposite the stream collecting channel, the first and second regions of the nozzle arrangement being inseparably connected to one another as a combined component.

22 Claims, 5 Drawing Sheets

(56) References Cited

U.S. PATENT DOCUMENTS

| | | | | |
|---|---|---|---|---|
| 5,620,138 | A * | 4/1997 | Crum | B05B 5/032 239/132.5 |
| 6,547,164 | B2 * | 4/2003 | Miquel | F04F 5/461 239/432 |
| 7,074,274 | B1 * | 7/2006 | Shutic | B05B 14/45 118/309 |
| 2002/0078883 | A1 * | 6/2002 | Shutic | B01D 45/14 118/50 |
| 2005/0082395 | A1 | 4/2005 | Gardega | |
| 2008/0191067 | A1 * | 8/2008 | Mauchle | B05B 5/0531 239/690 |
| 2013/0099026 | A1 * | 4/2013 | Mauchle | B65G 53/42 239/600 |

FOREIGN PATENT DOCUMENTS

| | | | |
|---|---|---|---|
| DE | 3042201 | A1 | 6/1982 |
| DE | 3542710 | A1 | 6/1987 |
| DE | 19729549 | A1 | 1/1999 |
| DE | 10315029 | A1 | 12/2003 |
| DE | 20306234 | U1 | 8/2004 |
| DE | 102006018066 | A1 | 10/2007 |
| DE | 202015009024 | U1 | 8/2016 |
| EP | 282873 | A2 | 9/1988 |
| WO | 2012112056 | A1 | 8/2012 |
| WO | 2013153096 | A1 | 10/2013 |
| WO | 20140170374 | A1 | 10/2014 |

OTHER PUBLICATIONS

International Search Report and Written Opinion dated Jan. 17, 2018, for corresponding PCT Application No. PCT/EP2017/079815.

German Office Action dated Jan. 27, 2020, received for corresponding 102017103316.5, 7 pages.

German Office Action dated Aug. 12, 2021, received for German Application No. 102017012346.2, 24 pages.

German Office Action dated Aug. 12, 2021, received for corresponding German Application No. 102017103316.5, 16 pages.

* cited by examiner

POWDER CONVEYING INJECTOR FOR CONVEYING COATING POWDER AND VENTURI NOZZLE ASSEMBLY

CROSS-REFERENCE TO RELATED APPLICATION(S)

The present application is the national phase of PCT Application No. PCT/EP2017/079815 filed on Nov. 20, 2017, which in turn claims priority to German Application No. 102017103316.5 filed on Feb. 17, 2017, the disclosures of which are incorporated by reference herein in their entireties.

BACKGROUND

The present disclosure relates to a powder conveying injector with a Venturi nozzle assembly as well as a Venturi nozzle assembly for powder conveying injectors.

In particular, the disclosure relates to powder conveying injectors for conveying coating powder having a drive nozzle and a collecting nozzle, wherein the collecting nozzle has a stream collecting channel disposed axially opposite from the drive nozzle at a distance. This arrangement of drive and collecting nozzle is also referred to herein as "Venturi nozzle assembly."

Nozzle assemblies of this type are used in powder conveying injectors which take advantage of the so-called Venturi effect in using conveying air to convey in particular fluidized coating powder from a powder reservoir and feed it through the collecting nozzle via for example a powder supply tube of a coating gun or similar mechanism for spraying coating powder. The collecting nozzle, usually configured as an elongated hollow body, forms a so-called stream collecting channel in its interior to that end into which the powder/air mixture to be conveyed is introduced.

The stream collecting channel of the collecting nozzle is disposed axially upstream of a drive or stream collecting nozzle through which propellant or conveying air is forced into the collecting nozzle. Due to the relatively small diameter of the drive or stream collecting nozzle, a high velocity airflow is formed, whereby a negative pressure is formed in a directly adjacent powder supply channel connected to the powder container. Due to the negative pressure, fluidized coating powder is conveyed in the powder supply channel from the powder reservoir to the collecting nozzle and conducted through same to the powder feed hose.

A powder conveying injector of this type having a corresponding Venturi nozzle assembly is known for example from the German DE 198 24 802 A1 published application.

Known prior art powder conveying injectors have the disadvantage of the drive nozzle and the collecting nozzle and in particular the stream collecting channel of the collecting nozzle being worn away by the airflow and the powder particles. Due to the abrasive effect of the coating powder, which is channeled through the collecting nozzle at high velocity, in particular the stream collecting channel of the collecting nozzle is subject to comparatively high wear, which generally becomes apparent from the abraded material leading to a widening of the stream collecting channel, which results in a decrease in pressure. Thus, over time, continually more propellant or conveying air is required to convey the coating powder which on the one hand is uneconomical and on the other hand can also lead to unsatisfactory coating results due to uneven coating powder flaws or to the conveyed volume of powder decreasing over time respectively.

For this reason, regularly replacing the collecting nozzles becomes necessary in powder conveying injectors. Alternatively or additionally known thereto, for example from DE 198 24 802 A1, is forming the collecting channel of the collecting nozzle from a relatively hard material, in particular glass.

Although regularly replacing collecting nozzles can counteract the disproportionate widening of the stream collecting channel cross section during operation of the powder conveying injector, this measure not does prevent the powder conveyance effected with the powder conveying injector from becoming increasingly more inefficient or poorer. This is because the drive nozzle of the powder conveying injector is also subject to at least creeping wear since the effective flow cross section or effective nozzle opening of the drive nozzle respectively cannot be prevented from changing during the operation of the powder conveying injector and thus no longer corresponding to the originally selected initial value optimized in terms of the powder conveying injector's operation and conveying efficiency.

Particularly when the drive nozzle is made of a plastic material, there is the risk of the nozzle opening of the drive nozzle widening over time due to the conveying air forced through the drive nozzle. If, however, the nozzle opening of the drive nozzle is made of metal, which is "harder" compared to plastic and thus subject to less wear, accumulation and sintering of powder particles onto the nozzle tip generally cannot be prevented since metal has the disadvantage of powder particles tending to adhere to and sinter onto it.

There is thus the generally unavoidable risk in the prior art of changes occurring to the effective nozzle cross section, or effective nozzle opening respectively, of the drive nozzle, and thus also the conveying flow of air, during operation of the powder conveying injector.

SUMMARY

The task to be solved is that of creating the opportunity of ensuring that the powder conveying injector will assure particularly efficient and optimized conveyance of coating powder after a routine or defect-related replacing of the collecting nozzle.

Accordingly, it is in particular provided by the present disclosure for the collecting nozzle and the drive nozzle to be inseparably connected together as one consolidated component. The term of "consolidated as one component" or respectively "inseparably connected together" as used herein is to be understood as a connection of the two "collecting nozzle" and "drive nozzle" components which can no longer be disengaged without destruction.

By the collecting nozzle and the drive nozzle of the powder conveying injector being connected together inseparably as one consolidated component, it is particularly easy for the user of the powder conveying injector to replace the drive nozzle at the same time as replacing the collecting nozzle, whether as a routine or defect-related measure, so that the powder conveying injector, or the mutually adapted nozzle assembly cross sections respectively, thereafter reflect the originally selected factory design. It should be considered here that in conventional powder conveying injectors, the drive nozzle was in fact only replaceable—if at all—with relatively great effort, which hence did not regularly occur in practice.

The disclosed solution, according to which the collecting nozzle and the drive nozzle are inseparably connected together as one consolidated component, moreover enables the powder conveying injector to be implemented as a so-called "inline injector" with which the coating powder to be conveyed by the powder conveying injector is fed axially to the powder conveying injector with respect to the longitudinal axis of the stream collecting channel.

This embodiment as "inline injector" has the decisive advantage that the coating powder to be conveyed in the powder conveying injector no longer needs to be deflected, or only barely, so that only minor turbulence—if any—and in particular less flow resistance results. This increases the conveying capacity of the powder conveying injector at the same conveying air volume, whereby the powder output can at the same time be further homogenized compared to conventional powder conveying injectors not configured as inline injectors. Moreover, the nozzle assembly's susceptibility to wear is significantly reduced since the degree of turbulence in the coating powder to be conveyed in the powder conveying injector is considerably reduced.

According to one accompanying aspect, the disclosure thus also relates to a powder conveying injector for conveying coating powder which comprises a drive nozzle and a collecting nozzle, wherein the collecting nozzle comprises a stream collecting channel disposed axially opposite from the drive nozzle at a distance, and wherein the drive nozzle comprises a powder inlet disposed axially opposite from the stream collecting channel at a distance.

According to a further accompanying aspect, the disclosure lastly also relates to a Venturi nozzle assembly for powder conveying injectors, wherein the nozzle assembly has a first region serving as a drive nozzle and a second region serving as a collecting nozzle, wherein the second region comprises a channel having a longitudinal axis serving as a stream collecting channel, and wherein the first region comprises a nozzle opening axially opposite the stream collecting channel, wherein the first and the second region of the nozzle assembly are inseparably connected or connectable together as one consolidated component.

The various aspects of the disclosure are summarized below:

First Aspect of the Present Disclosure:

According to a first aspect, the present disclosure relates to a powder conveying injector for conveying coating powder, wherein the powder conveying injector comprises a drive nozzle and a collecting nozzle, and wherein the collecting nozzle comprises a stream collecting channel disposed axially opposite from the drive nozzle at a distance. It is thereby in particular provided in the present disclosure for the collecting nozzle and the drive nozzle to be inseparably connected together as one consolidated component. A further development provides for the drive nozzle to comprise a powder inlet disposed axially opposite the stream collecting channel at a distance. Particularly thereby provided is for the drive nozzle to comprise a powder inlet which is disposed axially opposite the stream collecting channel at a distance and aligned with respect to an axis coinciding with a longitudinal axis defined by the stream collecting channel or running parallel to a longitudinal axis defined by the stream collecting channel. Alternatively thereto, embodiments of the disclosure provide for the drive nozzle to comprise a powder inlet aligned with respect to an axis intersecting a longitudinal axis defined by the stream collecting channel, preferably at 90° or at an obtuse angle.

Second Aspect of the Present Disclosure:

According to a second aspect, the present disclosure relates to a powder conveying injector for conveying coating powder, wherein the powder conveying injector comprises a drive nozzle and a collecting nozzle, and wherein the collecting nozzle comprises a stream collecting channel disposed axially opposite from the drive nozzle at a distance. It is thereby in particular provided in the present disclosure for the drive nozzle to comprise a powder inlet disposed axially opposite the stream collecting channel at a distance. A further development provides for the collecting nozzle and the drive nozzle to be inseparably connected together as one consolidated component.

Fundamental Aspects of the Present Disclosure:

An injector housing can be provided in the powder conveying injector according to the disclosure in which at least the drive nozzle is at least partially accommodated in preferably removable or replaceable manner. The collecting and drive nozzle inseparably connected together as one consolidated component preferably comprises at least one seal for sealing the component relative to the injector housing.

The disclosed powder conveying injector can provide for an injector housing in which at least the drive nozzle is at least partially accommodated, whereby the injector housing has a powder inlet region connectable to a powder line in which a powder inlet channel is formed axially with respect to the longitudinal axis of the collecting nozzle and fluidly connected to the powder inlet of the drive nozzle. An axial seal can be provided in the powder inlet channel, in particular in an upstream end region of said powder inlet channel.

The disclosed powder conveying injector can provide for an injector housing in which at least part of the collecting and drive nozzle consolidated preferably as a single component can be accommodated, whereby a mount is formed in the injector housing in which at least an upstream region of the collecting and drive nozzle preferably consolidated as a single component is accommodated, wherein the mount is of circular cylindrical and axial configuration with respect to the longitudinal axis of the collecting nozzle. A conveying air connection can be provided in the injector housing which is fluidly connected to the conveying air channel by an annular space formed between the mount of the injector housing and the collecting and drive nozzle consolidated as one component. The drive nozzle can comprise a conveying air inlet fluidly connected to the conveying air channel which is non-axially arranged and aligned with respect to the longitudinal axis of the collecting nozzle.

The collecting and drive nozzle preferably consolidated as one component in the disclosed powder conveying injector can be rotationally symmetric with respect to the longitudinal axis of the collecting nozzle.

A powder line connection can be further provided in the disclosed powder conveying injector for connecting a powder line, in particular a powder hose, to a downstream end region of the collecting nozzle, wherein the powder line connection is in particular detachably connected to the downstream end region of the collecting nozzle.

An injector housing can be provided in the disclosed powder conveying injector in which at least part of the collecting and drive nozzle preferably consolidated as a single component can be accommodated, wherein an upstream end region of the powder line connection is at least partially accommodated in the injector housing and detachably connected to the injector housing by means of a locking mechanism.

The collecting nozzle in the disclosed powder conveying injector can be made of a first material and the drive nozzle made of a second material, whereby the first material is different from the second material or identical to the second material.

The stream collecting channel in the disclosed powder conveying injector can be configured rotationally symmetric with respect to the longitudinal axis of the collecting nozzle. The collecting nozzle can be configured rotationally symmetric relative to the longitudinal axis.

The drive nozzle in the disclosed powder conveying injector can comprise a drive nozzle housing having a conveying air channel and a nozzle tip fluidly connected to the conveying air channel which is disposed axially opposite from the stream collecting channel. The nozzle tip can be configured as an insert and inseparably connected to the drive nozzle housing.

Third Aspect of the Present Disclosure:

According to a third aspect, the present disclosure relates to a Venturi nozzle assembly for powder conveying injectors, wherein the nozzle assembly has a first region serving as a drive nozzle and a second region serving as a collecting nozzle, whereby the second region comprises a channel having a longitudinal axis serving as a stream collecting channel, and whereby the first region comprises a nozzle opening axially opposite the stream collecting channel, wherein the first and the second region of the nozzle assembly are inseparably connected together as one consolidated component.

The first region serving as the drive nozzle can comprise a powder inlet which is disposed axially opposite the channel of the second region serving as the stream collecting channel at a distance. The nozzle assembly can preferably be removably or replaceably accommodated in an injector housing in such a manner that at least the first region of the nozzle assembly is at least partially accommodated in the injector housing. The nozzle assembly can comprise at least one seal for sealing the nozzle assembly relative to the injector housing.

The first region serving as the drive nozzle can comprise a conveying air inlet which is non-axially arranged and aligned with respect to the longitudinal axis of the second region channel serving as the stream collecting channel. The nozzle assembly can be configured rotationally symmetric with respect to the longitudinal axis of the channel serving as the stream collecting channel.

BRIEF DESCRIPTION OF THE DRAWINGS

The following will reference the accompanying drawings in describing an exemplary embodiment of the disclosure in greater detail.

Shown are.

DETAILED DESCRIPTION

Figure 1:
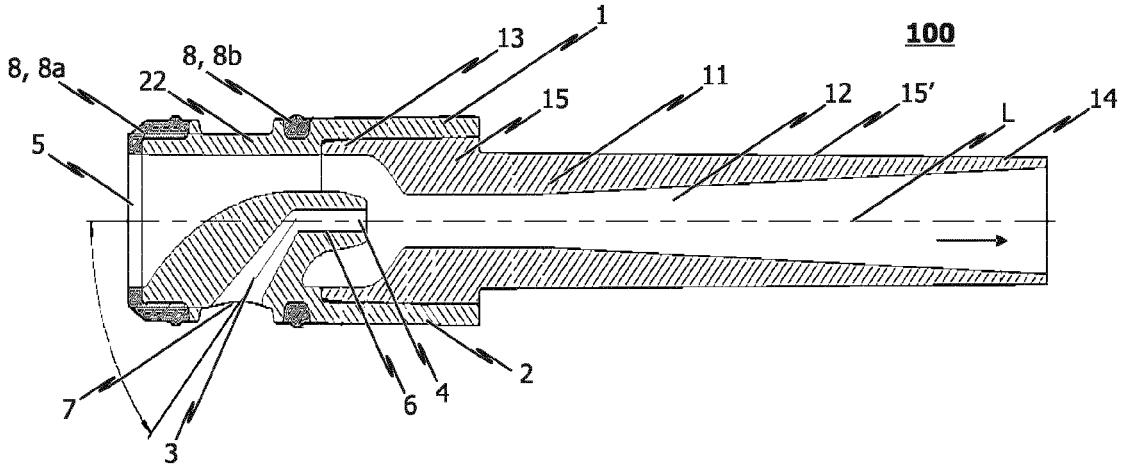
FIG. 1: a schematic sectional view of one embodiment of the disclosed Venturi nozzle assembly.

To convey powder from a drum or a container to a spray gun or other spraying device, particularly for the electrostatic spray coating of objects, an injector pump is usually used with a powder conveying injector which works according to the injector principle or Venturi tube principle. In said powder conveying injector, a current of air in a negative pressure area formed by channel widening produces a negative pressure which is used to draw coating powder from the container or drum. The extracted coating powder is carried along by the current of air and conveyed to the spraying device. The negative pressure and thus the amount of powder conveyed can be adjusted by adjusting the flow rate of the airflow.

The present disclosure is based on the problem of the known types of powder conveying injectors having the disadvantage of the air flow and the powder particles wearing away the drive nozzle and the stream collecting channel. This has more than just the disadvantage of the volumetric powder flow (amount of powder conveyed per unit of time) also changing as a function of the degree of wear, resulting in unequal coating thicknesses and coating qualities on an article to be coated.

It has at present in particular been recognized that not only can the collecting nozzle or respectively the stream collecting channel of the collecting nozzle be subjected to increased wear but also the drive nozzle as used in powder conveying injectors, although not usually to the extent as experienced by the stream collecting channel of the collecting nozzle since the drive nozzle is not normally exposed to the powder particles. Nevertheless, it is unavoidable that the drive nozzle will also wear over time in the operation of the powder conveying injector.

An exemplary embodiment of the Venturi nozzle assembly according to the present disclosure will first be described in greater detail in the following with reference to the representations provided in FIGS. 1 and 2. The Venturi nozzle assembly 100 is particularly suitable for powder conveying injectors 50 for conveying coating powder from a reservoir using conveying air.

The exemplary embodiment of the Venturi nozzle assembly 100 comprises a first region which serves as a drive nozzle 1 and a second region which serves as a collecting nozzle 11. The second region of the nozzle assembly 100, which serves as the collecting nozzle 11, comprises a channel with a longitudinal axis L in its interior which serves as a stream collecting channel 12. A mixture of coating powder and conveying air flows through this channel when the Venturi nozzle assembly 100 is for example used in a powder conveying injector 50 for conveying powder.

The channel, which is also referred to as stream collecting channel 12 or powder flow channel in the following, exhibits a longitudinal axis L, whereby the direction of flow is indicated in FIG. 1 by an arrow. The mixture of coating powder and conveying air to be conveyed enters into the second region serving as the collecting nozzle 11 at a funnel-shaped nozzle inlet 13 and exits the collecting nozzle 11 again at a nozzle outlet 14.

At least in the area of the nozzle inlet 13 and the area of the nozzle outlet 14, the second region, serving as collecting nozzle 11, is externally of cylindrical con-figuration so that corresponding cylindrical guide surfaces 15, 15' will be formed.

The first region of the nozzle assembly 100 arranged upstream of the second region (collecting nozzle 11) assumes the function of a drive nozzle 1. The second region (drive nozzle 1) essentially consists of a drive nozzle housing 2 having a conveying air channel 3 and a nozzle 4 fluidly connected to the conveying air channel 3, the nozzle opening of which is disposed axially opposite the stream collecting channel 12.

Although not depicted in FIG. 1, it is conceivable for the nozzle 4, or nozzle opening respectively, to be formed by a nozzle tip configured as a metal insert and in particular able to be inseparably connected to the drive nozzle housing 2.

The Venturi nozzle assembly 100 shown in schematic sectional view in FIG. 1 is in particular characterized by the first region serving as the drive nozzle 1 and the second region serving as the collecting nozzle 11 being consolidated as one single component and inseparably connected together. In principle conceivable in this context is for the first and second region 1, 11 of the nozzle assembly 100 to be integrally formed from one and the same material, for example as an injection-molded component.

Alternatively thereto, and as schematically suggested in FIG. 1, the first and second region 1, 11 of the nozzle assembly 100 can initially be formed separately, whereby these two regions 1, 11 are then inseparably connected together, for example by bonding or grouting. This would have the advantage of the two regions 1, 11 of the Venturi nozzle assembly 100 being able to be formed from different materials, in particular different plastic materials.

A further advantage of this embodiment is that the second region 11 of the nozzle assembly 100, which is of rotationally symmetrical configuration relative to the longitudinal axis L of the stream collecting channel 12, can be designed as a rotating part. This simplifies in particular the manufacture and assembly of the second region 11 of the nozzle assembly 100.

The nozzle assembly 100, as shown for example in schematic sectional view in FIG. 1, is moreover characterized by being a so-called "inline" nozzle assembly 100, which means that the coating powder to be conveyed by the nozzle assembly 100 flows axially through the entire nozzle assembly 100 along the longitudinal axis L of the stream collecting channel 12.

In particular provided with the exemplary embodiment of the nozzle assembly 100 is for the first region 1 of the nozzle assembly 100 to comprise a powder inlet 5 axially opposite from the nozzle outlet 14 (powder outlet) of the second region (collecting nozzle 11).

What this axial arrangement of the powder inlet 5 and powder outlet 14 is able to achieve is no deflecting, or at least only slightly, of the coating powder to be conveyed within the nozzle assembly 100, which significantly reduces the turbulence of the coating powder/air mixture in the nozzle assembly 100. Moreover, the coating powder/air mixture in the nozzle assembly 100 only experiences minimum flow resistance, which overall increases the conveying capacity achievable with the nozzle assembly 100 at the same volume of conveying air.

Specifically, and as schematically suggested in FIG. 1, the first region of the nozzle assembly 100, which serves as the drive nozzle 1, is of essentially cylindrical configuration and exhibits a drive nozzle housing 2 having a substantially cylindrical outer surface. This drive nozzle housing 2 at least partly defines an interior conveying air channel 3 arranged axially or at least substantially axially with respect to the longitudinal axis L of the stream collecting channel 1. A nozzle projection 6 in which the nozzle opening 4 of the drive nozzle 1 is formed extends into the conveying air channel 3.

The nozzle opening 4 is fluidly connected to a conveying air inlet 7 which is non-axially arranged and aligned with respect to the longitudinal axis L of the channel of the second region 11 serving as the stream collecting channel 12. Otherwise—as already stated above—the nozzle opening 4 of the drive nozzle 1 is axially arranged with respect to the longitudinal axis L of the stream collecting channel 12.

During operation of the nozzle assembly 100, conveying air is supplied via the conveying air inlet 7 of the drive nozzle 1, same flowing from the nozzle opening 4 of the drive nozzle 1 toward the stream collecting channel 12. Due to the nozzle-shaped assembly of at least the upstream region of the stream collecting channel 12, the conveying air is forced into the collecting nozzle 11 and due to the relatively small diameter of the nozzle opening 4 of the drive nozzle 1, a high velocity air flow forms, whereby negative pressure forms in the area of the powder inlet 5 of the nozzle assembly 100. Due to the negative pressure developing in the powder inlet region during the operation of the nozzle assembly 100, coating powder is drawn in when the powder inlet 5 of the first region 1 of the nozzle assembly 100 serving as the drive nozzle 1 is fluidly connected to a suitable powder container or the like via powder line, etc.

As schematically indicated in FIG. 1, the drive nozzle housing 2 exhibits a cylindrical inner contour at its downstream end region into which the upstream end region of the second region 11 of the nozzle assembly 100; i.e. the upstream end region of the nozzle assembly 100 region serving as the collecting nozzle 11 can be inserted and accordingly inseparably connected to the drive nozzle housing 2 (for example by bonding or grouting).

In all, the first and second region 1, 11 of the nozzle assembly 100 are thus inseparably connected together as one consolidated component. These two regions 1, 11 inseparably connected together as one consolidated component exhibit an overall external contour which is preferably rotationally symmetric with respect to the longitudinal axis L of the stream collecting channel 12. The nozzle assembly 100 can in this way be arbitrarily inserted into a mount 21 of a injector housing 20 without the user needing to pay attention to a specific alignment of the nozzle assembly 100.

As can be further inferred from the schematic sectional view according to FIG. 1, the nozzle assembly 100 is provided with suitable seals 8, via which the nozzle assembly 100 can be sealed with respect to an injector housing 20 when the nozzle assembly 100 is accommodated in the injector housing 20.

It is thereby specifically preferential for at least two circumferential sealing areas 8*a*, 8*b* to be provided, wherein a groove or annular groove 22 is formed between the two circumferential sealing areas 8*a*, 8*b*. The conveying air inlet 7 of the drive nozzle 1 also empties into this region where the groove or annular groove 22 is formed between the two circumferential sealing areas 8*a*, 8*b*.

Figure 2:
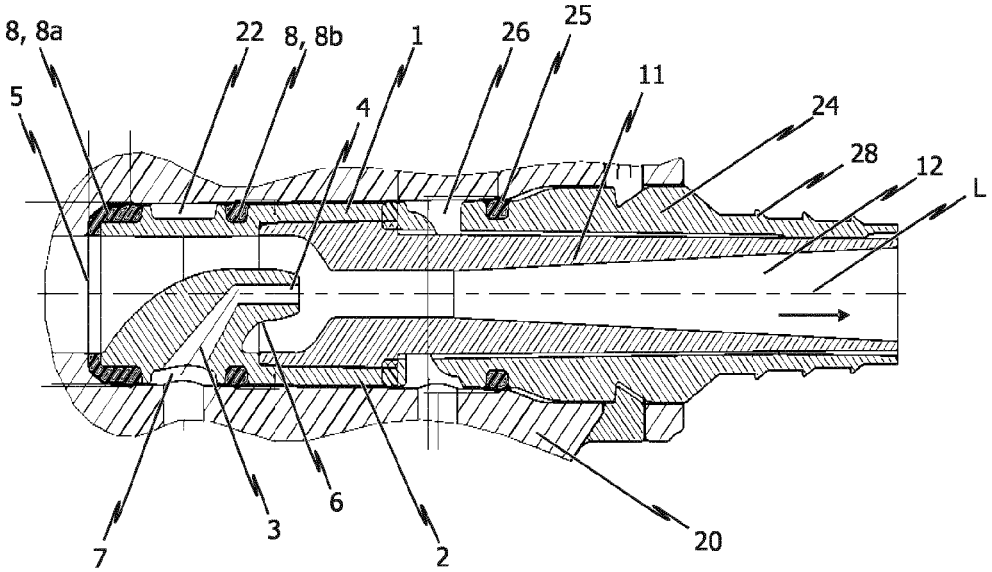
FIG. 2: a schematic sectional view of the exemplary embodiment of the disclosed Venturi nozzle assembly in a state accommodated in an injector housing.

In schematic and sectional view, FIG. 2 shows the exemplary embodiment of the nozzle assembly 100 according to FIG. 1 in a state in which the nozzle assembly 100 is at least partly accommodated in a housing, in particular injector housing 20.

As depicted, the housing/injector housing 20 comprises a mount 21 to that end, the size of which is adapted to the outer diameter and external configuration of at least the upstream end region of the first region (drive nozzle 1) of the nozzle assembly 100. At least the upstream end region of the nozzle assembly 100 is sealed with respect to the wall of the mount 21 provided in the injector housing 20 by the sealing rings 8*a*, 8*b* of the nozzle assembly 100.

The FIG. 2 depiction further indicates that the groove or annular groove 22 formed between the two circumferential sealing areas 8*a*, 8*b* of the nozzle assembly 100 forms an annular space with the wall of the mount 21 of the injector housing 20, wherein said annular space is fluidly connected via a conveying air connection 23 formed in the injector housing 20.

Further able to be inferred from the FIG. 2 schematic sectional view is that a powder line connection 24 is attached to the downstream end region of the second region of the nozzle assembly 100 (collecting nozzle 11) and in particular detachably connected to the downstream end region.

The powder line connection 24 to that end comprises a receiving channel axially arranged with respect to the longitudinal axis L of the stream collecting channel 12 in which at least part of the downstream end region of the collecting nozzle can be accommodated. Furthermore, the powder line connection 24 can exhibit—as FIG. 2 schematically indicates—a corresponding seal 25 so as to in particular seal the powder line connection 24 vis-à-vis the injector housing 20.

The powder line connection 24 is attachable to the downstream end region of the collecting nozzle 11 such that an annular space 26 limited by the injector housing 20, the powder line connection 24 as well as the nozzle assembly 100 is formed which is fluidly connected to a metering air channel 27 formed in the injector housing 20. Metering air, which can be added to the coating powder/air mixture conveyed by the nozzle assembly 100, can be fed to the annular space 26 via said metering air channel 27.

An exemplary embodiment of the powder conveying injector 50 will be described in greater detail in the following with reference to the representations provided in FIGS. 3, 4 and 5*a-e*.

Briefly summarized, the exemplary embodiment of the powder conveying injector 50 comprises a nozzle assembly 100 as well as an injector housing 20. The nozzle assembly 100 is in particular a nozzle assembly 100 as described above with reference to the representations in FIGS. 1 and 2.

The nozzle assembly 100 as used with the powder conveying injector 50 depicted schematically in FIGS. 3, 4 and 5*a-e* is thus a nozzle assembly 100 consisting of a drive nozzle 1 and a collecting nozzle 11, wherein the collecting nozzle 11 com-prises a stream collecting channel 12 disposed axially opposite the drive nozzle 1 at a distance. The collecting nozzle 11 and the drive nozzle 1 are thereby in particular inseparably connected together as one consolidated component.

The nozzle assembly 100 employed in the exemplary embodiment of the powder conveying injector 50 is further characterized by the drive nozzle 1 of the nozzle assembly 100 comprising a powder inlet 5 disposed axially opposite the stream collecting channel 12 at a distance.

At least part of the nozzle assembly 100 and in particular the drive nozzle 1 of the nozzle assembly 100 is preferably removably or replaceably accommodated in the injector housing 20 of the powder conveying injector 50.

The nozzle assembly 100 is preferably configured rotationally symmetrical with respect to the longitudinal axis L of the stream collecting channel 12. Consequently, the nozzle assembly 100 can be at least partially accommodated in the injector housing 20 irrespective of its rotational orientation, which simplifies the replaceability of the nozzle assembly 100.

Figure 3:
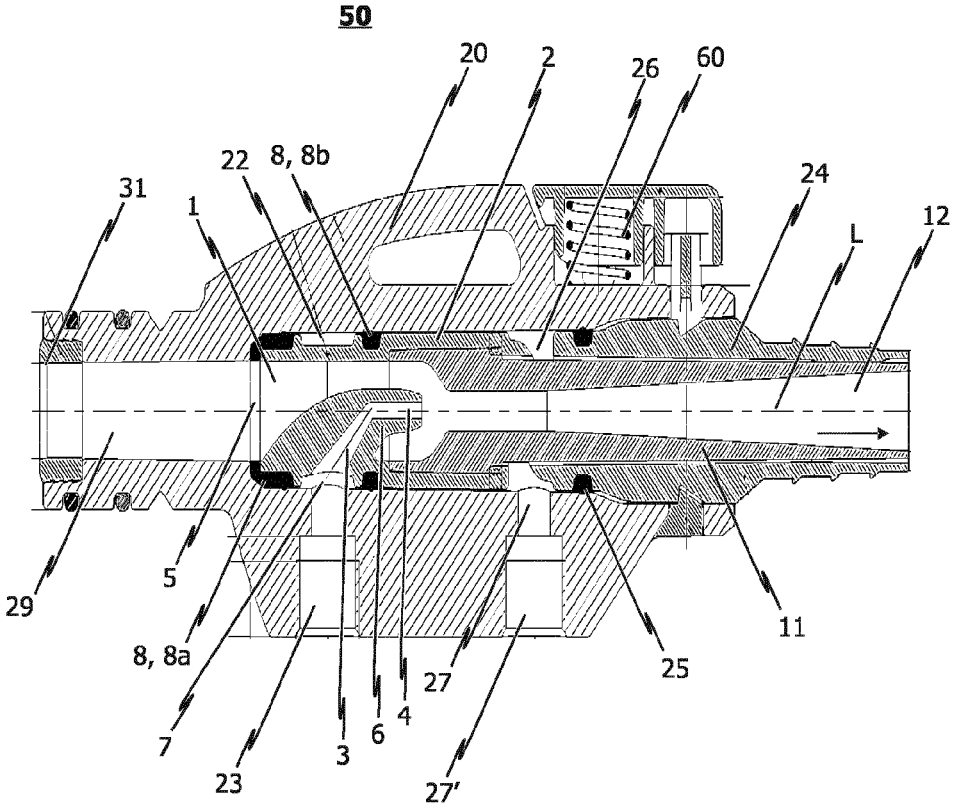
FIG. 3: a schematic sectional view of an exemplary embodiment of the disclosed powder conveying injector.

Further to be learned from the FIG. 3 representation is, for example, that the nozzle assembly 100 comprises two circumferential ring seals 8*a*, 8*b* at least in the region of the drive nozzle 1, between which a groove or channel 22 respectively is formed. This groove/channel 22 defines an annular space in the inserted state of the nozzle assembly 100 which is fluidly connected to a conveying air channel 3 configured in the injector housing 20 and in particular non-axially aligned so that regardless of the rotational orientation of the nozzle assembly 100, the conveying air channel 3 of the nozzle assembly 100 can always be supplied with conveying air. This is directly shown by the schematic sectional view according to FIG. 3.

The representation according to FIG. 3 further shows that the exemplary embodiment of the powder conveying injector 50 further comprises a powder line connection 24 which serves to connect a powder line, in particular a powder hose, to the downstream end region of the collecting nozzle 11 of the nozzle assembly 100. Hereby in particular provided is for the powder line connection 24 to be detachably connected to the downstream end region of the collecting nozzle 11 of the nozzle assembly 100.

For example—as shown in FIG. 3—the powder line connection 24 can be configured as a hose connector able to be slipped over the downstream end region of the collecting nozzle 11.

Conceivable in this context is for the powder line connection 24 configured for example as a hose connector to be secured to the injector housing 20 by means of a union nut when slipped over the downstream end region of the collecting nozzle 11.

In accordance with the exemplary embodiment of the powder conveying injector 50 depicted in the drawings, however, a locking mechanism 60 with which the powder line connection 24 can be detachably connected to the injector housing 20 is used in place of such a union nut.

The powder line connection 24 realized in particular as a hose connector is detachably connected to the downstream end region of the collecting nozzle 11 such that an annular space 26 defined by the nozzle assembly 100, the injector housing 20 and the powder line connection 24 is formed when the nozzle assembly 100 together with the powder line connection 24 is at least partly accommodated in the injector housing 20 (for this, see the schematic sectional view according to FIG. 3).

This annular space 26 is fluidly connected to a metering air channel 27 formed in the injector housing 20, via which metering air can be supplied to the annular space 26 as needed.

The upstream end region of the powder line connection 24 realized in particular as a hose connector preferably exhibits helical ribs 28 which in a state in which the nozzle assembly 100 together with the powder line connection 24 is at least partly accommodated in the injector housing 20, defines corresponding metering air channels which are fluidly connected to the annular space 26, or the metering air channel 27 formed in the injector housing 20 respectively. The metering air fed into the metering air channel 27 of the injector housing 20 via these metering air channels then can be added to the mixture of conveying air and coating powder.

It is advantageous in this context for the ribs 28 provided in particular at the upstream end region of the powder line connection preferably realized as a hose connector 24 to be of helical configuration so as to give the metering air to be supplied to the conveying air/coating powder mixture a certain angular momentum. The ribs 28 also have the advantage of increasing the grip of the powder line connection 24.

After the locking mechanism 60 has been unlocked, the nozzle assembly 100 together with the powder line connection 24 can be easily manually pulled out of the injector housing 20, or the mount 21 provided in the injector housing 20 for the nozzle assembly 100 respectively.

The powder line connection 24 configured in particular as a hose connector can consist of an electrically non-conductive material and its exterior enclosed by a layer or a sleeve of electrically conductive material. The sleeve enclosing the powder line connection 24 in particular configured as a hose connector can be made for example of metal or an electrically conductive plastic. Using a hose connector as described in the DE 202 04 116 U1 printed publication as the powder line connection 24 would for example be conceivable.

Figure 6:
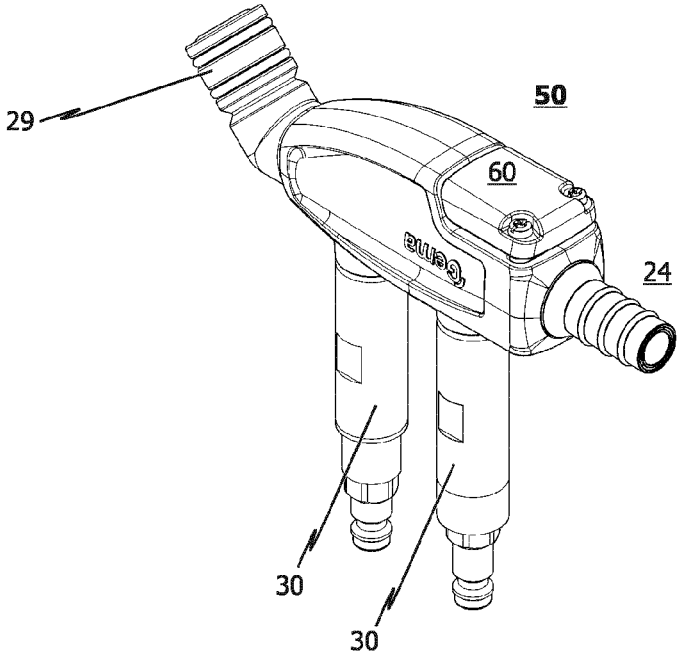
FIG. 6: a schematic and isometric view of a further exemplary embodiment of the disclosed powder injector.

The following will reference the FIG. 6 depiction in describing a further exemplary embodiment of the powder conveying injector 50.

Figure 4:
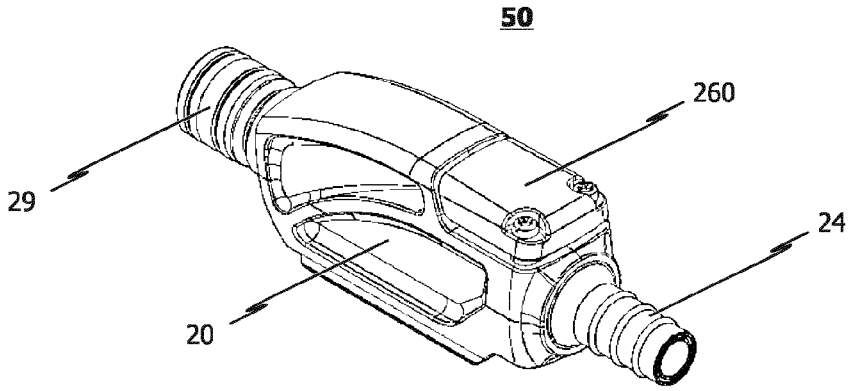
FIG. 4: a schematic and isometric view of the exemplary embodiment of the disclosed powder injector according to FIG. 3.
Figure 5A:
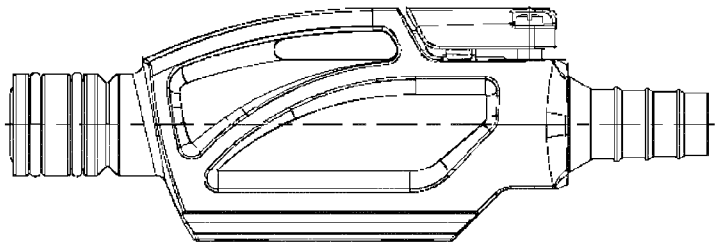
FIG. 5*a* to *e*: different schematic views of the exemplary embodiment of the disclosed powder injector according to FIG. 4.
Figure 5B:
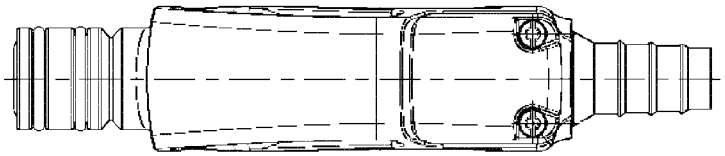
Figure 5C:
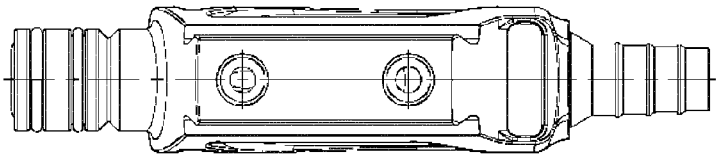
Figure 5D:
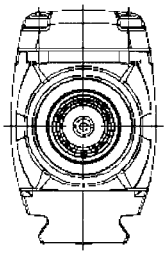
Figure 5E:
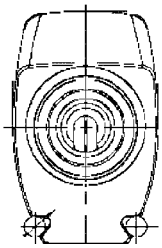

Briefly summarized, the exemplary embodiment of the powder conveying injector 50 exhibits a structure which corresponds in principle to the structure of the powder conveying injector 50 previously described with reference to the depictions in FIGS. 3 to 5.

Accordingly, the powder conveying injector 50 comprises an injector housing 20 with a mount 21 in which a nozzle assembly 100 realized as a single component is replaceably accommodated. The nozzle assembly 100 used in the powder conveying injector 50 according to the embodiment depicted in FIG. 6 preferably corresponds to the nozzle assembly 100 as previously described with reference to the depictions in FIGS. 1 and 2. To avoid repetition, reference is therefore made to the previous remarks.

The powder conveying injector 50 comprises a powder supply channel 29 which is fluidly connected to a powder container (or "hopper"), wherein the powder supply channel 29 preferably runs at least substantially axially to the conveying axis (see FIG. 3). As indicated in FIGS. 6 and 7, it is however also conceivable for the powder supply channel 29 of powder conveying injector 50 to be slightly angled relative to the conveying axis.

The advantage obtained as a result is the achieving of improved coating powder conveying capacity at the same volume of conveying air and the same negative pressure generated by the conveying air flow in the powder supply channel 29 compared to conventional powder conveying injectors 50, their powder supply channels extending at an angle of for instance 90° to the conveying axis.

The powder conveying injector 50 further comprises a conveying air connection 24 connectable to a conveying air hose or similar line by a suitable filter device 30. A metering air connection 27' of the powder conveying injector 50 is also connectable to a conveying air hose or similar line by a suitable filter device 30.

Figure 7:
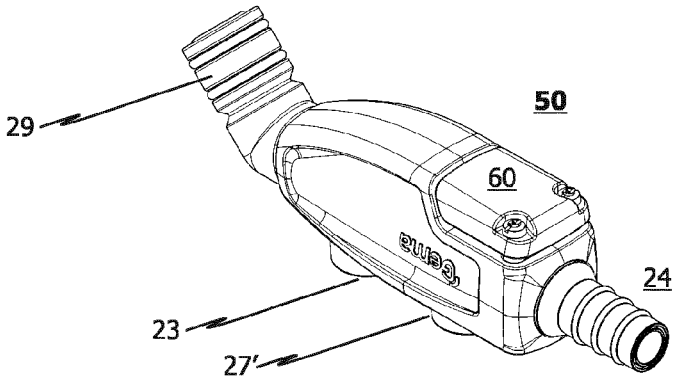
FIG. 7: a schematic and isometric view of a further exemplary embodiment of the disclosed powder injector.

The further exemplary embodiment of the powder conveying injector 50 schematically depicted in FIG. 7 essentially corresponds to the embodiment according to FIG. 6, whereby, however, no filter devices 30 are provided in the embodiment according to FIG. 7.

The coating powder conveyed by the powder conveying injector 50 according to the present disclosure can be routed by the powder conveying injector 50 to a further container or to a spraying device, for example a manual or automatic spray gun, by means of which the coating powder is sprayed onto articles to be coated.

The magnitude of the volumetric powder flow (volume of powder conveyed per unit of time) mainly depends on the magnitude of the negative pressure or vacuum in the negative pressure area at the upstream end of the drive nozzle 1 and thus primarily the magnitude of the conveying air flow.

With small volumes of powder per unit of time, the conveying air flow can be so weak that powder deposits develop in the powder line connecting the powder conveying injector 50 to where the powder is received. It is therefore customary to supply additional air in the form of metering air to the coating powder/conveying air flow downstream of the negative pressure area in order to regulate the total volume of air required for deposit-free powder conveyance in the powder line.

Accordingly, one or more metering air connections 27' can be provided for the metering air downstream of the collecting nozzle 11 or in said collecting nozzle 11 or upstream of said collecting nozzle 11.

As it can be inferred from the representation provided in FIG. 6 and FIG. 7, it is not absolutely imperative for the powder supply channel 29 to be axially configured with respect to the longitudinal axis L of the stream collecting channel 12. Indeed, the powder supply channel 29 here extends at an obtuse angle of approximately 45°. This preferably does not apply, however, to the powder inlet 5 of the nozzle assembly 100, which is preferably axially configured with respect to the longitudinal axis L of the stream collecting channel 12.

The coating powder conveyed by the powder conveying injector 50 serves in particular for the electrostatic spray coating of objects and can consist for example of plastic, ceramic or another coating material. The invention is however not limited to systems for electrostatically spray coating objects with coating powder but can also be used to convey powder for other purposes.

The invention claimed is:

1. A powder conveying injector for conveying coating powder comprising a drive nozzle extending along a longitudinal axis, the drive nozzle comprising:

a powder passage disposed about the longitudinal axis and having a powder inlet situated at an upstream end of the drive nozzle and configured to be fluidly connected to a powder container, the powder passage defined by a circumferential wall;

a nozzle projection extending from the circumferential wall into the powder passage, downstream of the powder inlet, the nozzle projection comprising:

a conveying air nozzle opening arranged substantially coaxially within the powder passage and directed downstream along the longitudinal axis;

a conveying air inlet arranged non-axially with respect to the longitudinal axis; and a conveying air channel directly connecting the conveying air inlet and the conveying air nozzle opening;

wherein the drive nozzle is configured to direct conveying air axially along the longitudinal axis into a conveyed powder drawn from the powder inlet; and a collecting nozzle, wherein the collecting nozzle comprises a stream collecting channel disposed axially opposite from the drive nozzle at a distance and concentric with the longitudinal axis, and wherein:

the collecting nozzle and the drive nozzle are consolidated into one component such that the collecting nozzle and the drive nozzle can only be replaced simultaneously.

2. The powder conveying injector according to claim 1, wherein the powder inlet is disposed axially opposite the stream collecting channel at a distance and aligned with respect to an axis coinciding with the longitudinal axis defined by the stream collecting channel or running parallel to the longitudinal axis defined by the stream collecting channel; or wherein the powder inlet is aligned with respect to an axis intersecting the longitudinal axis defined by the stream collecting channel, at an angle of 90° or at an obtuse angle.

3. A powder conveying injector for conveying coating powder comprising a drive nozzle extending along a longitudinal axis, the drive nozzle comprising:

a powder passage disposed about the longitudinal axis and having a powder inlet situated at an upstream end of the drive nozzle and configured to be fluidly connected to a powder container, the powder passage defined by a circumferential wall;

a nozzle projection extending from the circumferential wall into the powder passage, downstream of the powder inlet, the nozzle projection comprising:

a conveying air nozzle opening arranged substantially coaxially within the powder passage and directed downstream along the longitudinal axis;

a conveying air inlet arranged non-axially with respect to the longitudinal axis; and a conveying air channel directly connecting the conveying air inlet and the conveying air nozzle opening;

wherein the drive nozzle is configured to direct conveying air axially along the longitudinal axis into a conveyed powder drawn from the powder inlet; and a collecting nozzle, wherein the collecting nozzle comprises a stream collecting channel disposed axially opposite from the drive nozzle at a distance and concentric with the longitudinal axis, and wherein:

the powder inlet is disposed axially opposite the stream collecting channel at a distance.

4. The powder conveying injector according to claim 3, wherein the collecting nozzle and the drive nozzle are inseparably connected together as one consolidated component.

5. The powder conveying injector according to claim 1, wherein an injector housing is further provided in which at least the drive nozzle is at least partially accommodated in a removable or replaceable manner.

6. The powder conveying injector according to claim 5, wherein the collecting nozzle and drive nozzle comprise at least one seal for sealing components relative to the injector housing.

7. The powder conveying injector according to claim 1, wherein an injector housing is provided in which at least the drive nozzle is at least partially accommodated, and wherein the injector housing has a powder supply channel connectable to a powder line which is fluidly connected to the powder inlet of the drive nozzle.

8. The powder conveying injector according to claim 7, wherein an axial seal is provided in an upstream end region of said powder supply channel.

9. The powder conveying injector according to claim 1, wherein an injector housing is provided in which at least part of the collecting nozzle and drive nozzle consolidated as a single component can be accommodated, and wherein in a mount is formed in the injector housing in which at least an upstream region of the collecting nozzle and drive nozzle consolidated as a single component is accommodated, wherein the mount is of circular cylindrical and axial configuration with respect to the longitudinal axis of the collecting nozzle.

10. The powder conveying injector according to claim 9, wherein a conveying air connection is provided in the injector housing which is fluidly connected to the conveying air channel by an annular space formed between the mount of the injector housing and the collecting nozzle and drive nozzle consolidated as one component.

11. The powder conveying injector according to claim 1, wherein the collecting nozzle and drive nozzle consolidated as one component is rotationally symmetric with respect to the longitudinal axis of the collecting nozzle.

12. The powder conveying injector according to claim 1, wherein a powder line connection is further provided for connecting a powder line to a downstream end region of the collecting nozzle, wherein the powder line connection is detachably connected to the downstream end region of the collecting nozzle.

13. The powder conveying injector according to claim 12, wherein an injector housing is provided in which at least part of the collecting nozzle and drive nozzle consolidated as a single component is accommodated, and wherein an upstream end region of the powder line connection is at least partially accommodated in the injector housing and detachably connected to the injector housing by means of a locking mechanism.

14. The powder conveying injector according to claim 1, wherein the collecting nozzle is made of a first material and the drive nozzle is made of a second material, wherein the first material is different from the second material.

15. The powder conveying injector according to claim 1, wherein the stream collecting channel is configured rotationally symmetric with respect to the longitudinal axis of the collecting nozzle.

16. The powder conveying injector according to claim 15, wherein the collecting nozzle is configured rotationally symmetric relative to the longitudinal axis.

17. The powder conveying injector according to claim 1, wherein the conveying air nozzle opening is defined by a nozzle tip configured as an insert.

18. A Venturi nozzle assembly for powder conveying injectors, wherein the Venturi nozzle assembly has a first region serving as a drive nozzle and a second region serving as a collecting nozzle, wherein the first and second regions extend along a longitudinal axis and are inseparably connected together as one consolidated component;

wherein the first region serving as the drive nozzle comprises:

a powder passage disposed about the longitudinal axis and having a powder inlet situated at an upstream end of the drive nozzle and configured to be fluidly connected to a powder container, the powder passage defined by a circumferential wall;

a nozzle projection extending from the circumferential wall into the powder passage downstream of the powder inlet, the nozzle projection comprising:

a conveying air nozzle opening arranged substantially coaxially within the powder passage and directed downstream along the longitudinal axis;

a conveying air inlet arranged non-axially with respect to the longitudinal axis; and a conveying air channel directly connecting the conveying air inlet and the conveying air nozzle opening;

wherein the drive nozzle is configured to direct conveying air axially along the longitudinal axis into a conveyed powder drawn from the powder inlet; and wherein the second region serving as the collecting nozzle comprises a channel disposed concentric with the longitudinal axis and serving as a stream collecting channel.

19. The Venturi nozzle assembly according to claim 18, wherein the powder inlet is disposed axially opposite the channel of the second region serving as the stream collecting channel at a distance.

20. The Venturi nozzle assembly according to claim 18, wherein the Venturi nozzle assembly is removably or replaceably accommodated in an injector housing such that at least the first region of the nozzle assembly is at least partially accommodated in the injector housing.

21. The Venturi nozzle assembly according to claim 20, wherein the Venturi nozzle assembly comprises at least one seal for sealing the Venturi nozzle assembly relative to the injector housing.

22. The Venturi nozzle assembly according to claim 18, wherein the Venturi nozzle assembly is configured rotationally symmetric with respect to the longitudinal axis of the channel serving as the stream collecting channel.

* * * * *